US010273817B2

(12) United States Patent
Roussille et al.

(10) Patent No.: US 10,273,817 B2
(45) Date of Patent: Apr. 30, 2019

(54) TURBINE RING ASSEMBLY WITH INTER-SECTOR CONNECTIONS

(71) Applicants: HERAKLES, Le Haillan (FR); SNECMA, Paris (FR)

(72) Inventors: Clément Roussille, Bordeaux (FR); Thierry Tesson, Bordeaux (FR); Freddy Guilbaud, Le Taillan Medoc (FR)

(73) Assignees: SAFRAN CERAMICS, Le Haillan (FR); SAFRAN AIRCRAFT ENGINES, Paris (FR)

( * ) Notice: Subject to any disclaimer, the term of this patent is extended or adjusted under 35 U.S.C. 154(b) by 351 days.

(21) Appl. No.: 15/086,987

(22) Filed: Mar. 31, 2016

(65) Prior Publication Data

US 2016/0290144 A1 Oct. 6, 2016

(30) Foreign Application Priority Data

Apr. 1, 2015 (FR) ..... 15 52816

(51) Int. Cl.
*F01D 9/04* (2006.01)
*F01D 11/08* (2006.01)
(Continued)

(52) U.S. Cl.
CPC ..... *F01D 9/04* (2013.01); *F01D 11/08* (2013.01); *F01D 11/12* (2013.01); *F01D 25/246* (2013.01);
(Continued)

(58) Field of Classification Search
CPC ..... F01D 9/04; F01D 25/246; F01D 11/08; F01D 11/12; F01D 11/122; F01D 11/14;
(Continued)

(56) References Cited

U.S. PATENT DOCUMENTS 4,676,715 A * 6/1987 Imbault ..... F01D 25/246 415/116
9,945,256 B2 * 4/2018 Freeman ..... F01D 25/246
(Continued)

FOREIGN PATENT DOCUMENTS

EP 0 192 516 A1 8/1986
WO WO 2006/136755 A2 12/2006

OTHER PUBLICATIONS

Search Report as issued in French Patent Application No. 1552816, dated Jan. 29, 2016.

*Primary Examiner* — Igor Kershteyn
*Assistant Examiner* — Topaz L. Elliott
(74) *Attorney, Agent, or Firm* — Pillsbury Winthrop Shaw Pittman LLP

(57) ABSTRACT

A turbine ring assembly includes a ring support structure and a plurality of CMC ring sectors forming a turbine ring. Each ring sector is K-shaped in radial section, with tabs extending from the outside face of the annular base over end portions of the annular base, the tabs and the end portions of each ring sector being held respectively facing tabs and end portions of ring sectors that are adjacent in the ring. The turbine ring assembly has a plurality of rigid gaskets, each extending axially between adjacent ring sectors, and resilient holder devices exerting a force suitable for holding the gaskets in contact with the end portions or the tabs of two adjacent ring sectors.

6 Claims, 6 Drawing Sheets

(51) Int. Cl.
*F01D 11/12* (2006.01)
*F01D 25/24* (2006.01)

(52) U.S. Cl.
CPC ..... *F05D 2240/11* (2013.01); *F05D 2250/75* (2013.01); *F05D 2300/6033* (2013.01)

(58) Field of Classification Search
CPC ..... F01D 11/16; F01D 11/18; F01D 11/24; F01D 11/025; F05D 2240/11; F05D 2250/75
USPC ..... 415/173.3
See application file for complete search history.

(56) References Cited

U.S. PATENT DOCUMENTS

2012/0027572 A1 2/2012 Denece et al.
2016/0084101 A1* 3/2016 McCaffrey ..... F01D 5/225 415/173.3

* cited by examiner

TURBINE RING ASSEMBLY WITH INTER-SECTOR CONNECTIONS

CROSS-REFERENCE TO RELATED APPLICATIONS

This application claims priority to French Patent Application No. 1552816, filed Apr. 1, 2015, the entire contents of this application is incorporated herein by reference in its entirety.

BACKGROUND OF THE INVENTION

The invention relates to a turbine ring assembly for a turbine engine, which assembly comprises a ring support structure and a plurality of single-piece ring sectors made of ceramic matrix composite material.

The field of application of the invention is in particular that of gas turbine aeroengines. Nevertheless, the invention is applicable to other turbine engines, e.g. industrial gas turbines.

Ceramic matrix composite materials (CMCs) are known for conserving their mechanical properties at high temperatures, thereby making them suitable for constituting hot structural elements.

In gas turbine aeroengines, improving efficiency and reducing certain polluting emissions has led to seeking operation at ever-higher temperatures. When a turbine ring assembly is made entirely out of metal, it is necessary to cool all of the elements of the assembly, and in particular the turbine ring, which is subjected to the hottest streams. Such cooling has a significant impact on the performance of the engine since the cooling stream that is used is taken from the main stream through the engine. In addition, the use of metal for the turbine ring puts a limit on potential increases of temperature in the turbine, even though such increases would nevertheless make it possible to improve the performance of aeroengines.

That is why it has already been envisaged to use CMCs for various hot portions of engines, particularly since CMCs present the additional advantage of density that is lower than that of the refractory metals that have traditionally been used.

Thus, making turbine ring sectors as single pieces of CMC is described in particular in Document US 2012/0027572. Each ring sector comprises an annular base having an inside face that defines the inside face of the turbine ring and an outside face from which there extend two tab-forming portions with ends that are engaged in housings of a metal ring support structure.

The use of CMC ring sectors makes it possible to reduce significantly the ventilation needed for cooling the turbine ring. Nevertheless, although each ring sector is fastened individually to the ring support structure, holding the sectors in position relative to one another can sometimes be problematic since it can be difficult to control the shape of the turbine ring made up of the sectors. Furthermore, another problem resides in the stresses generated by the imposed movements. In addition, sealing between the gas flow passage on the inside of the ring sectors and the outside of the ring sectors remains a problem at the edges of adjacent ring sectors.

OBJECT AND SUMMARY OF THE INVENTION

The invention seeks to avoid such drawbacks, and for this purpose it proposes a turbine ring assembly comprising a ring support structure and a plurality of ring sectors made of ceramic matrix composite material making up a turbine ring, each ring sector comprising an annular base with, in a radial direction of the turbine ring, an inside face defining the inside face of the turbine ring and an outside face facing the inside face of the ring support structure, each said annular base including at each circumferential end a circumferential edge that is held facing a circumferential edge of the circumferential end of the annular base of a ring sector that is adjacent in the turbine ring, the assembly being characterized in that each ring sector presents a K-shape in a plane defined by the radial direction and the circumferential direction of the turbine ring, with tabs extending from the outside face of the annular base over the end portions of said annular base, circumferential edges of the tabs and the circumferential edges of the circumferential ends of each ring sector being held respectively facing the circumferential edges of tabs and the circumferential edges of ring sectors that are adjacent in the ring, and in that the turbine ring assembly includes a plurality of rigid gaskets, each rigid gasket extending axially between two adjacent ring sectors, together with resilient holder devices exerting force holding the gaskets in contact with the circumferential ends or the tabs of two adjacent ring sectors.

The rigid gaskets arranged and held in this way between the ring sectors serve to create a mechanical connection between adjacent ring sectors that improves holding the ring sectors in position, and consequently that improves controlling the shape of the turbine ring. By placing and holding a gasket over the zone where the axial edges of the sectors face one another in the ring, leaks of the gas stream flowing inside the passage formed by the inside face of the ring sectors are limited. In addition, since the gaskets are held by resilient holder devices, the gaskets are held in position and consequently the passage is sealed, even in the event of movements imposed by differential thermal expansion.

According to an aspect of the turbine ring assembly of the invention, the ring support structure has an upstream annular radial flange and a downstream annular radial flange with the ring sectors being held between them without being attached to said flanges, each gasket having an upstream end passing through a slot formed in the upstream radial flange and a downstream end passing through a slot formed in the downstream radial flange. Since the ring sectors are not fastened directly to the support structure, the imposed movements are significantly reduced, and consequently the stresses on the ring sectors are significantly reduced. The ring sectors can thus be positioned more easily relative to one another in order to define a more coherent shape for the turbine ring.

Advantageously, each resilient holder device comprises at least one spring element present beside the outside face of the ring support structure. Thus, the spring elements are spaced away from the hot stream flowing in the passage and they are exposed only to temperatures that are compatible with the material from which the spring element(s) is/are made. There is therefore no need to cool these elements, and it is possible to use more ordinary materials for fabricating them, such as metal materials.

In another aspect of the turbine ring assembly of the invention, the gaskets are constituted by strips of ceramic matrix composite material.

In another embodiment of a turbine ring assembly of the invention, each resilient holder device comprises a bolt and a spring, the bolt having a head present between the outside face of a gasket and tabs of two adjacent sectors, the spring being mounted in a prestressed state between a shroud of the ring support structure and a nut fastened to the end of the bolt remote from its end having the head.

In another embodiment of a turbine ring assembly of the invention, each resilient holder device comprises a finger having a free end pressing against a ring sector, there being a spring element mounted in a prestressed state against each finger. In an aspect of this embodiment, an annular gasket extends over the ring sectors, said annular gasket being interposed between the free ends of the fingers of the resilient holder devices and the ring sectors.

BRIEF DESCRIPTION OF THE DRAWINGS

The invention can be better understood on reading the following description given by way of non-limiting indication and with reference to the accompanying drawings, in which.

DETAILED DESCRIPTION OF EMBODIMENTS

Figure 1:
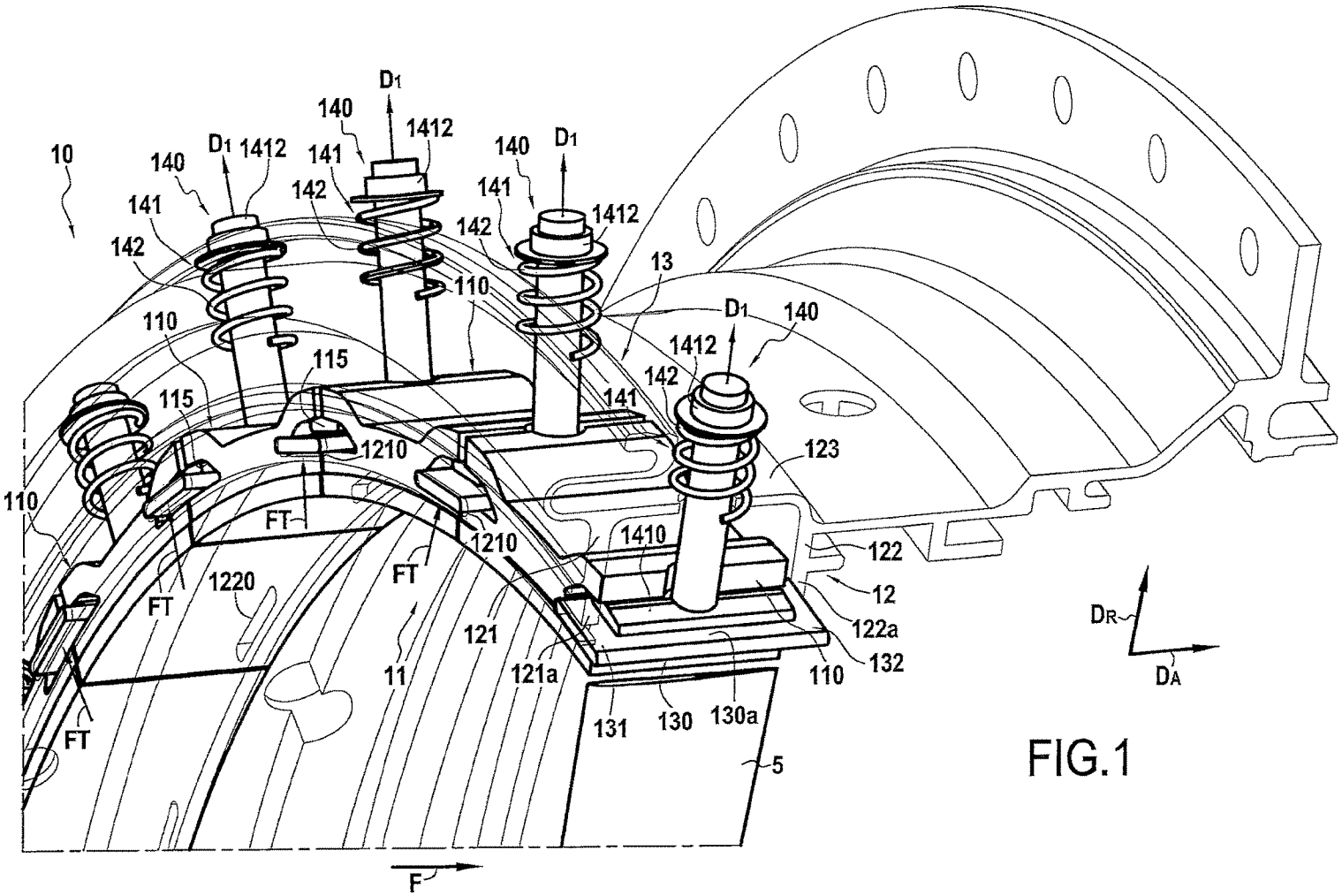
FIGS. 1 and 2 are perspective views showing a portion of a turbine ring assembly in accordance with an embodiment of the invention.
Figure 2:
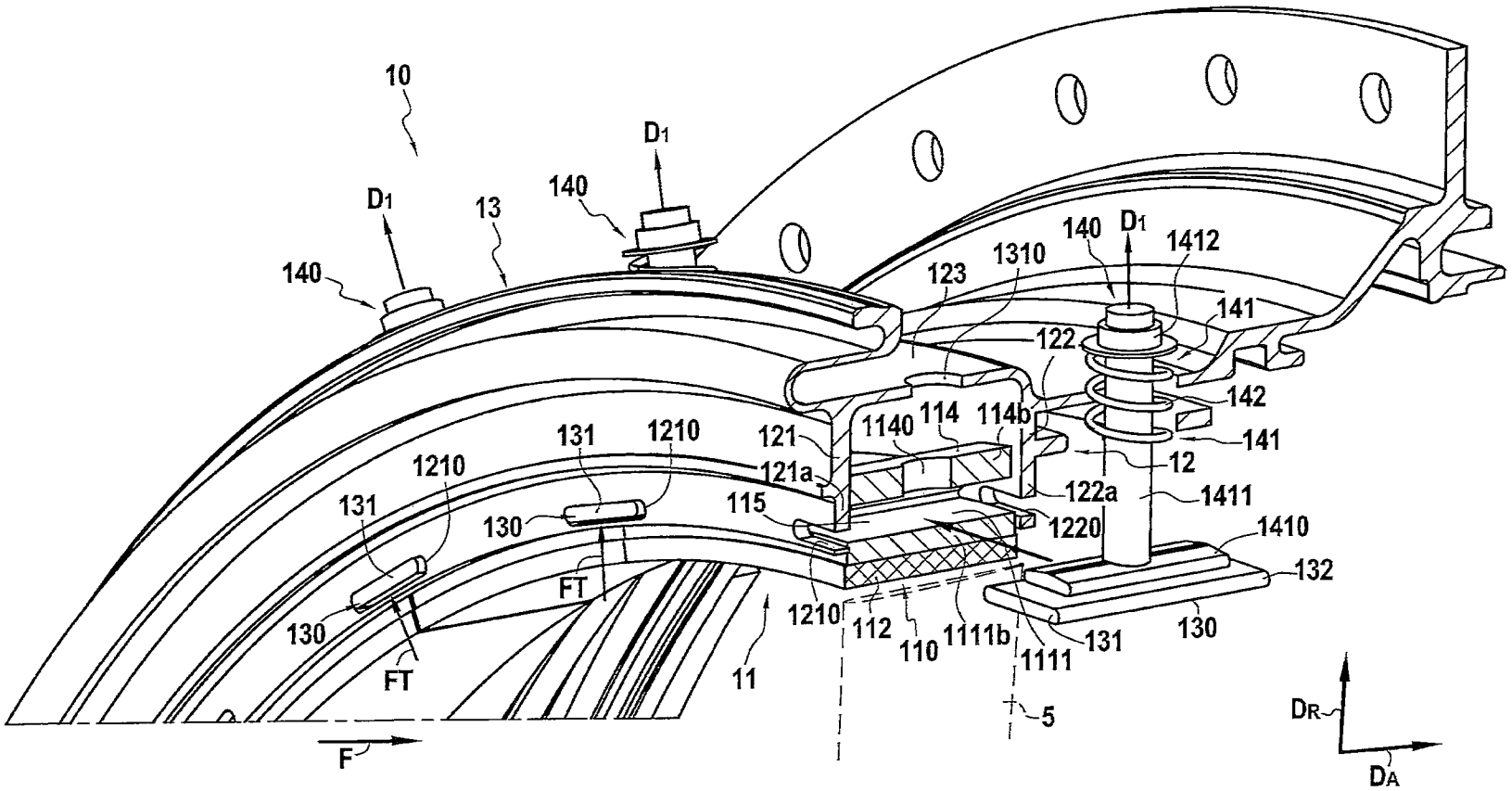

FIGS. 1 and 2 show a high-pressure turbine ring assembly 10 in an embodiment of the invention. The assembly 10 comprises a CMC turbine ring 11 and a metal ring support structure 12. The turbine ring 11 surrounds a set of rotary blades 5. The turbine ring 11 is made up of a plurality of ring sectors 110, with FIGS. 1 and 2 being perspective views showing a portion of the high-pressure turbine ring assembly 10 with an axial section showing the edges of a ring sector 110. Arrow $D_A$ points in the axial direction of the turbine ring 11 and arrow $D_R$ points in the radial direction of the turbine ring 11.

Figure 3:
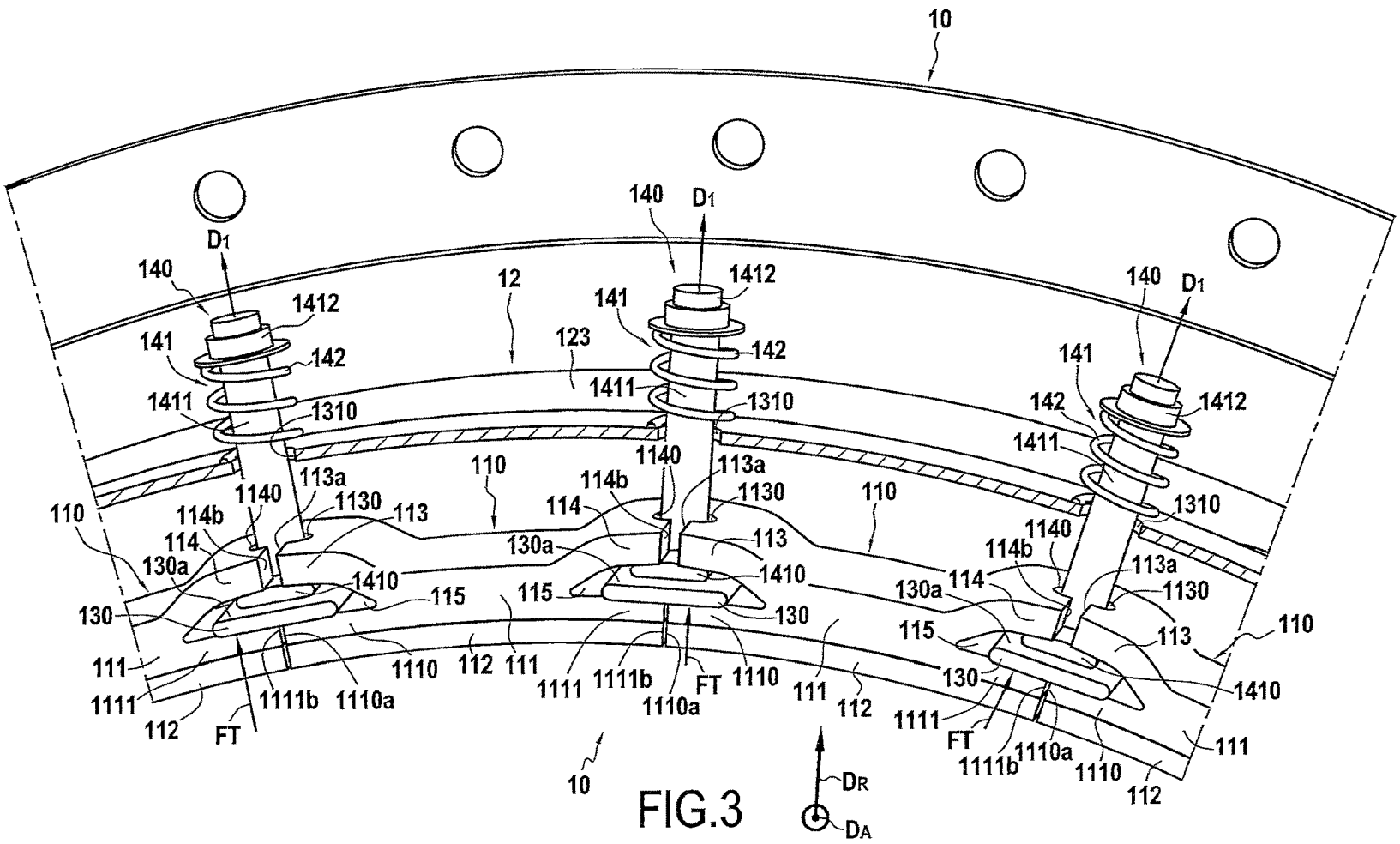
FIG. 3 is a radial section view of the turbine ring assembly of FIGS. 1 and 2.

As shown in FIG. 3, each ring sector 110 is K-shaped in a plane defined by the radial direction $D_R$ and by the circumferential direction of the turbine ring 11, the sector having an annular base 111 with its inside face in the radial direction $D_R$ coated in a layer 112 of abradable material, this inside face defining the flow passage for the gas stream through the turbine. Substantially S-shaped tabs 113, 114 extend from the outside face of the annular base 111 in the radial direction $D_R$, over its entire width, and above circumferential ends 1110 and 1111 of the annular base 111. Each annular sector 110 thus has two circumferential edges 1110*a* & 113*a* and 1111*b* & 114*b* at each of its ends. The edges 1110*a* and 113*a* situated on a first end of a sector 110 are for being held facing respective edges 1111*b* and 114*b* of the ring sector that is adjacent in the turbine ring.

The ring support structure 12 is secured to a turbine casing 13. The structure 12 has an upstream annular radial flange 121 and a downstream annular radial flange 122 that extend from a shroud 123 of the turbine casing. The terms "upstream" and "downstream" are used herein with reference to the flow direction of the gas stream through the turbine (arrow F in FIGS. 1 and 2). The flanges 121 and 122 present respective bottom edges 121*a* and 122*a*.

The ring sectors 110 are arranged in annular manner between the flanges 121 and 122 of the metal ring support structure 12, the inside face of the ring having the layer 112 of abradable material extending beyond the bottom edges 121*a* and 122*a* of the flanges 121 and 122.

In order to provide good sealing between the flow passage for the gas stream through the turbine and the outside of the turbine ring, gaskets 130 are placed between adjacent ring sectors at their facing edges. More precisely, the gaskets 130 are dimensioned and placed in such a manner as to cover the end portions 1111 and 1110 of the annular bases 111 of two adjacent ring sectors 110 in the axial direction of the ring 21 (i.e. parallel to the flow direction F). The gaskets 130 are placed in respective housings 115, each having its bottom formed by the circumferential ends 1111 and 1110 of two adjacent sectors in combination, the top portion of each housing 115 being formed by the tabs 114 and 113 of two adjacent sectors in combination. In this example, the gaskets 130 are made of CMC. The upstream ends 131 and the downstream ends 132 of the gaskets 130 pass through respective slots 1210 and 1220 formed respectively in the upstream and downstream flanges 121 and 122 (FIGS. 1 and 2).

The ring sectors 110 and the gaskets 130 are held by a traction device 140 constituted by a bolt 141 and a spring 142. The bolt 141 has a head 1410 that is placed between the outer face 130*a* of the corresponding gasket 130 and the tabs 114 and 113 of two adjacent sectors. Notches 1140 and 1130 are formed respectively in the tabs 114 and 113 so as to pass the shank 1411 of the bolt 141. Likewise, orifices 1310 are formed in the shroud 131 of the turbine casing 13 so as to pass the shank 1411 of the bolt 141.

The spring 142 is a compression spring mounted in a prestressed state between the shroud 123 and a nut 1412 engaged on the end of the bolt 141 remote from its end having the head 1410. Thus, the spring 142 exerts a force on the nut 1412 that is directed radially towards the outside of the ring 11 in a direction $D_1$ shown in FIGS. 1 and 3 and transmitted to the head 1410 of the bolt 141 via the shank 1411 of the bolt. The head 1410 then exerts a force that is directed in the direction $D_1$ on the tabs 113 and 114 of two adjacent sectors 110. This force is also transmitted to the circumferential ends 1110 and 1111 of two adjacent sectors 110 that in turn exert a force FT that is directed radially towards the outside of the ring 11 against the gasket 130 interposed between the circumferential ends 1110 and 1111 of the tabs 113 and 114 of two adjacent sectors 110. Under the effect of this force, the gaskets 130 are held in abutment against the top portions of the slots 1210 and 1220 formed respectively in the flanges 121 and 122. Sealing between adjacent sectors, i.e. sealing between the gas flow passage on the inside of the ring sectors and on the outside of the ring sectors, is thus provided by the gaskets 130. In addition, since both the ring sectors 110 and the gaskets 130 are held in position by resilient means (springs 142), mechanical connection and sealing between the ring sectors is ensured even when movements are imposed by differential thermal expansion.

Since each spring 142 is placed beside the outside face of the ring support structure (outside face of the shroud 123), it is spaced away from the hot stream flowing in the passage and is exposed only to temperatures that are compatible with the material of the spring. There is therefore no need to cool the springs, and it is possible to use materials such as metal materials for fabricating them.

Figure 4:
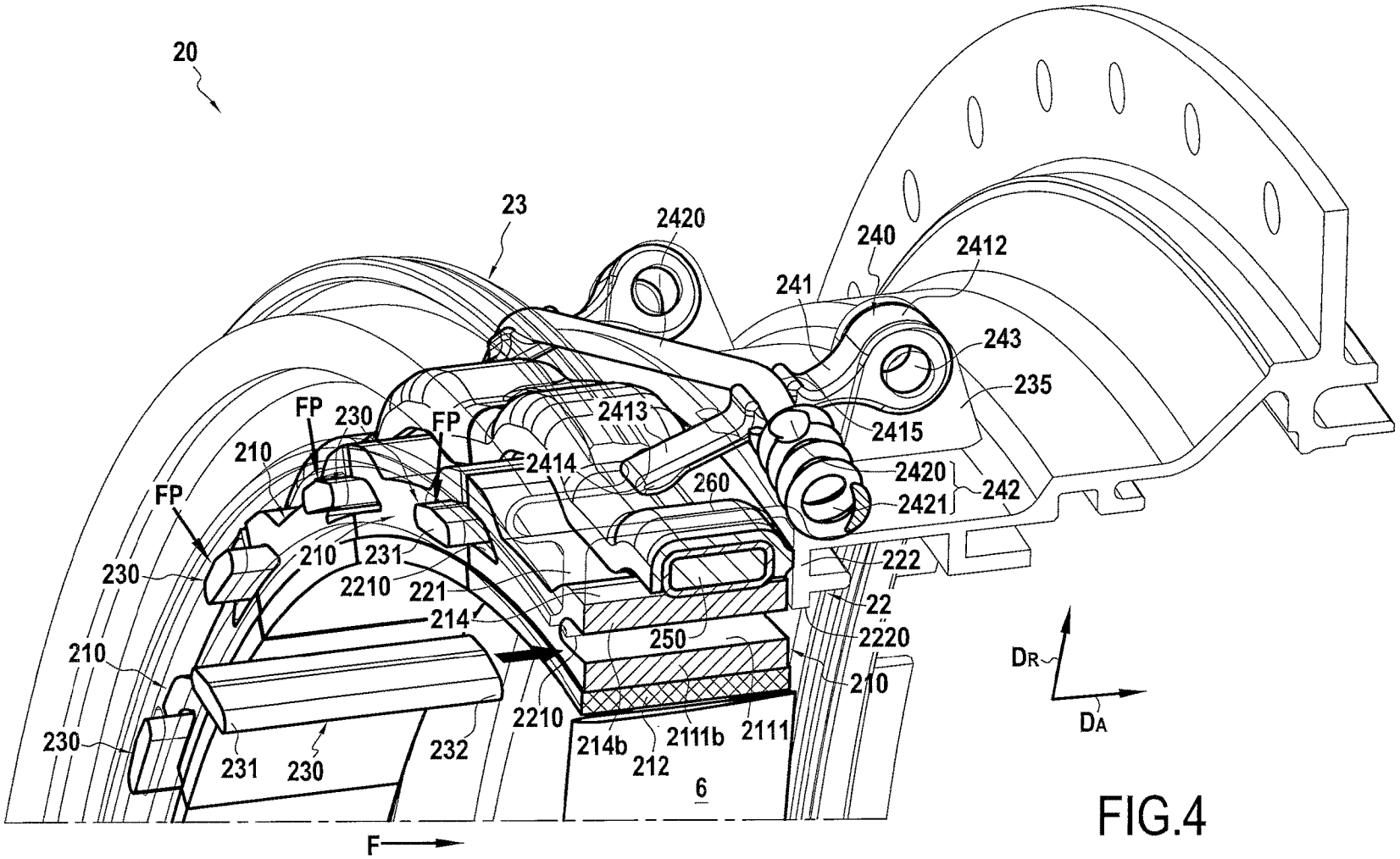
FIG. 4 is a perspective view showing a portion of a turbine ring assembly in accordance with another embodiment of the invention.

FIG. 4 shows a high-pressure turbine ring assembly 20 in accordance with another embodiment of the invention. The assembly 20 comprises a CMC turbine ring 21 and a metal ring support structure 22. The turbine ring 21 surrounds a set of rotary blades 6. The turbine ring 21 is made up of a plurality of ring sectors 210, with FIG. 4 being a perspective view showing a portion of the high-pressure turbine ring assembly 20 with an axial section showing the edges of a ring sector 210.

Figure 6:
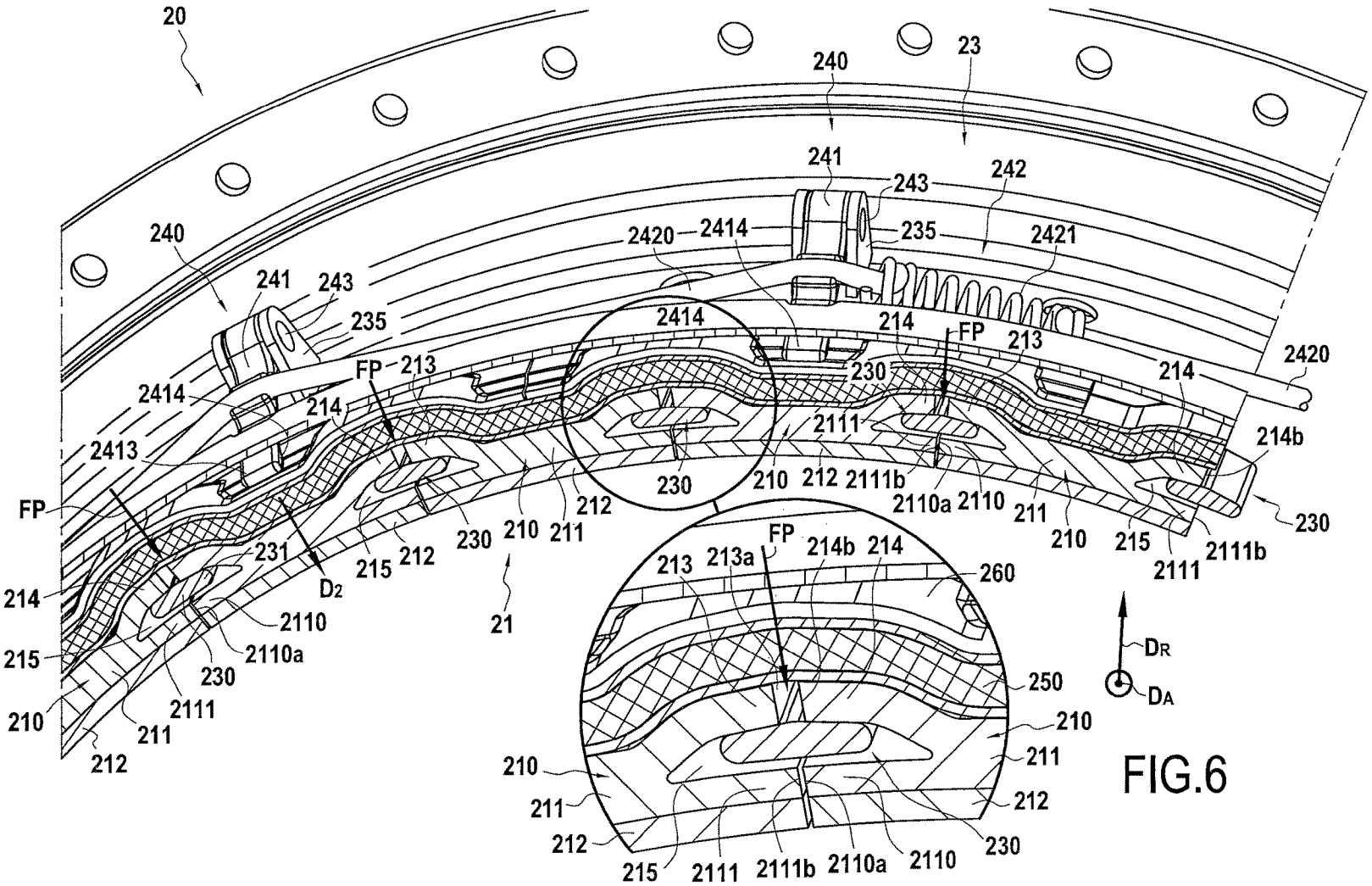
FIG. 6 is a radial section view of the turbine ring assembly of FIG. 4.

As shown in FIG. 6, each ring sector 210 is of a shape similar to the shape of the above-described sectors 110, i.e. it is K-shaped with an annular base 211 having its inside face coated in a layer 212 of abradable material defining the flow passage for the gas stream through the turbine. Substantially S-shaped tabs 213, 214 extend from the outside face of the annular base 211 over its entire width and over the ends 2110 and 2111 of the annular base 211. Each ring sector 210 thus has two circumferential edges 2110*a* & 213*a* and 2111*b* & 214*b* at each of its ends. The edges 2110*a* and 213*a* situated at a first end of a sector 210 are for being held respectively facing the edges 2111*b* and 214*b* of the ring sector that is adjacent in the turbine ring.

The ring support structure 22 is secured to a turbine casing 23. The structure 22 has an upstream annular radial flange 221 and a downstream annular radial flange 222 that extend from a shroud 231 of the turbine casing. The terms "upstream" and "downstream" are used with reference to the flow direction of the gas stream in the turbine (arrow F in FIG. 4). The flanges 221 and 222 present respective bottom edges 221*a* and 222*a*. The ring sectors 210 are arranged in annular manner between the flanges 221 and 222 of the metal ring support structure 22, the inside face of the ring having a layer 212 of abradable material that projects beyond the bottom edges 221*a* and 222*a* of the flanges 221 and 222.

Figure 5:
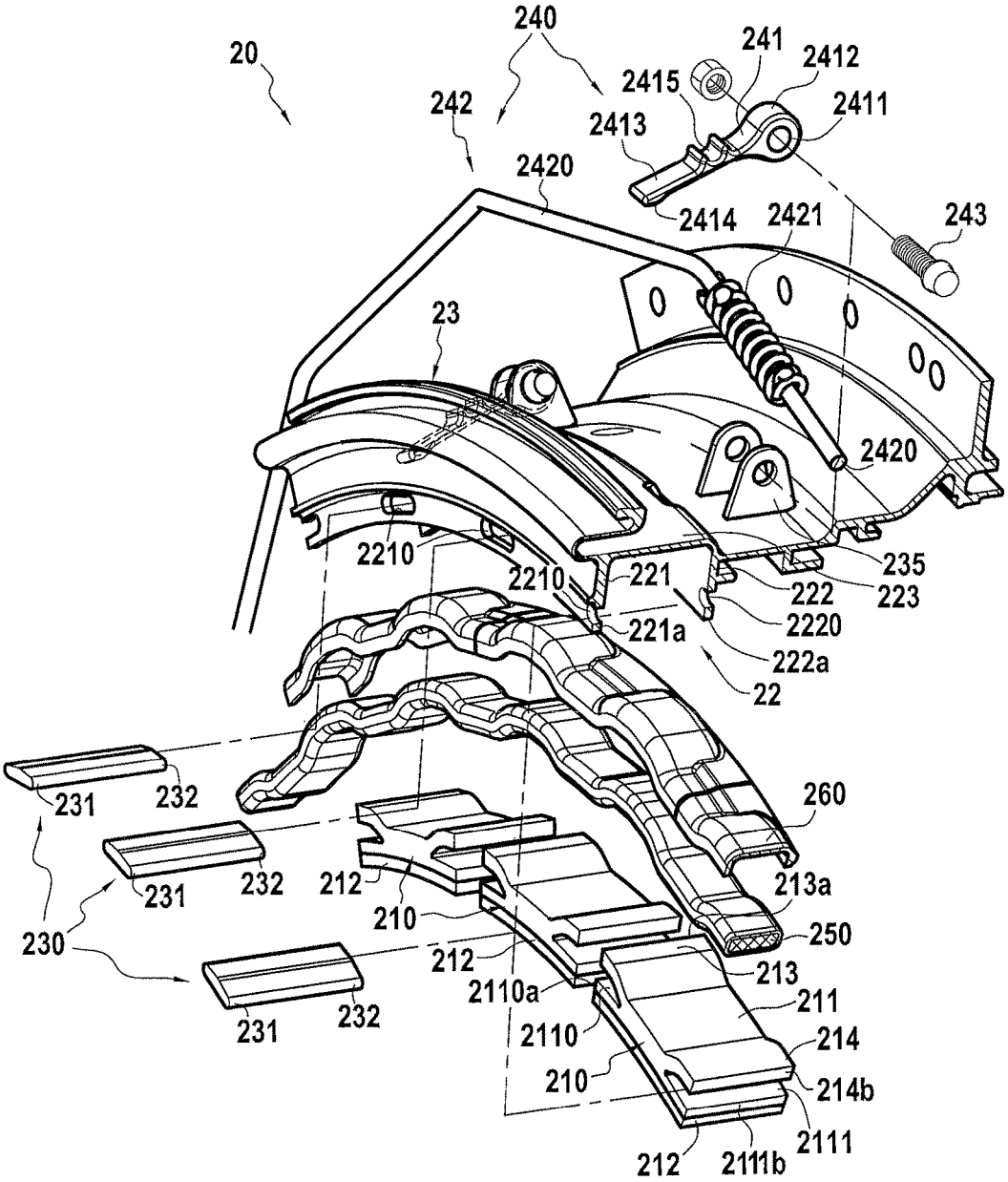
FIG. 5 is an exploded view showing the component elements of the FIG. 4 ring portion.

In order to provide good sealing between the flow passage for the gas stream through the turbine and the outside of the turbine ring, gaskets 230 are placed between adjacent ring sectors at their facing ends. More precisely, the gaskets 230 are dimensioned and placed in such a manner as to cover simultaneously parts of both tabs 214 and 213 of two adjacent ring sectors 110 in the axial direction of the ring 21 (parallel to the flow direction F). Each gasket 230 is placed in a respective housing 215 having its bottom formed by the ends 2111 and 2110 of two adjacent sectors in combination, the top portion of the housing 215 being formed by the tabs 214 and 213 of two adjacent sectors in combination. In this example, the gaskets 230 are made of CMC. The upstream and downstream ends 231 and 232 of the gaskets 230 pass through respective slots 2210 and 2220 arranged respectively in the upstream and downstream flanges 221 and 222 (FIGS. 4 and 5).

Each pair of adjacent ring sectors 210 and the gaskets 230 that is present between the adjacent ring sectors are held by a corresponding presser device 240 having a finger 241. Each finger 241 is pivotally mounted on the casing 23 by a pin 243 housed both in a bore 2411 formed in a proximal portion 2412 of the finger 241 and in a fork 235 secured to the casing 23. Each finger 241 has a free end 2414 in its distal portion 2413, which end is for exerting a pressing or thrust force against the underlying ring sector so as to hold one or more gaskets 230 in contact with the tabs of the adjacent ring sectors. To this end, a spring element 242 is used that is constituted in this example by a rigid cable 2420 having at least one spring 2421 interposed between two ends of the cable 2420. The cable 2420 with at least one spring 2421 is mounted in a prestressed state around the casing 23 and passes through a retaining portion 2415 present on each finger 241. In a variant embodiment, the cable may be made directly out of an elastic material, the cable then being mounted on its own in a prestressed state around the casing and passing through each of the guide portions of the fingers.

Thus, the cable 2420 exerts a force on the fingers 241 that is directed in a direction $D_2$ as shown in FIGS. 4 and 6, and that is transmitted to the free ends 2414 of the fingers 241. Each free end 2414 then exerts a thrust force on the underlying ring sector that is directed in the direction $D_2$. This thrust force is also transmitted to the tabs 213 and 214 of the underlying ring sector 210, which in turn exerts a thrust force FP directed radially towards the inside of the ring 21 against the gaskets 230 that are interposed between the circumferential ends 2110 and 2111 of the tabs 213 and 214 of adjacent neighboring sectors 210. Under the effect of this thrust force, the gaskets 230 are held in abutment against the bottom portions of the slots 2210 and 2220 formed respectively in the flanges 221 and 222. Sealing between adjacent sectors, i.e. sealing between the gas flow passage on the inside of the ring sectors and the outside of the ring sectors, is thus provided by the gaskets 230. In addition, since both the gaskets 230 and the ring sectors 210 are held in position by resilient means (cable 2420 with springs 2421), mechanical connection and sealing between the ring sectors is ensured even in the event of movements imposed by differential thermal expansion.

Since the cable 2420 with its spring 2421 and the fingers 241 are placed beside the outside face of the ring support structure (outside face of the shroud 23), they are spaced apart from the hot stream flowing in the passage and they are exposed only to temperatures that are compatible with the materials suitable for being used for fabricating them, such as metal materials.

In the presently-described embodiment, the fingers 241 do not press directly against the ring sectors 210. An annular gasket 250 extends over the ring sectors 210 and the gasket 250 is held in position by the fingers 241 that exert a force on a spacer 260 placed between the free ends 2414 of the fingers 241 and the annular gasket 250. Under such circumstances, the thrust force exerted by the fingers 241 is transmitted to the ring sectors 210 via the spacer 260 and the annular gasket 250. The gasket 250 is made of a thermally insulating material such as a felt of oxide (alumina) fibers, or it may be constituted by an elastically deformable insulating material such as a fiber structure or an insulating foam that is held inside a braid made using fibers that withstand high temperatures, such as ceramic fibers.

The turbine ring assembly 20 can also be made without any annular gasket or spacer. Under such circumstances, the free ends 2414 of the fingers 241 press directly against the top portions of the ring sectors 210. Likewise, the fingers can exert a thrust force without using a spring cable as described above. By way of example, the fingers may be of a resilient nature and they may be mounted with prestress against the ring sectors, possibly with an annular gasket and a spacer being interposed. A spring element may also be provided between the fork and the proximal portion of each finger so as to transmit a pressing force to the fingers.

Each above-described ring sector is made of CMC by forming a fiber preform of shape close to the shape of the ring sector and by densifying the ring sector with a ceramic matrix.

In order to make the fiber preform, it is possible to use yarns made of ceramic fibers, e.g. SiC fiber yarns such as those sold by the Japanese supplier Nippon Carbon under the name "Nicalon", or carbon fiber yarns.

The fiber preform is advantageously made by three-dimensional weaving, or by multilayer weaving with zones of non-interlinking being provided to make it possible to space preform portions corresponding to the tabs 113 and 114 apart from the sectors 110 or corresponding to the tabs 213 and 214 apart from the sectors 210.

The weaving may be of the interlock type, as shown. Other three-dimensional or multilayer weaves can be used, such as for example multi-plain or multi-satin weaves. Reference may be made to Document WO 2006/136755.

After weaving, the blank may be shaped in order to obtain a ring sector preform that is consolidated and densified with a ceramic matrix, it being possible for densification to be performed in particular by chemical vapor infiltration (CVI) as is well known.

A detailed example of fabricating CMC ring sectors is described in particular in Document US 2012/0027572.

The invention claimed is:

1. A turbine ring assembly comprising a ring support structure and a plurality of ring sectors made of ceramic matrix composite material making up a turbine ring, each of the plurality of ring sectors comprising an annular base with, in a radial direction of the turbine ring, an inside face defining the inside face of the turbine ring and an outside face facing the inside face of the ring support structure, each said annular base including at each circumferential end a circumferential edge that is held facing a circumferential edge of the circumferential end of the annular base of an adjacent one of the plurality of ring sectors in the turbine ring, wherein each of the plurality of ring sectors presents a K-shape in a plane defined by the radial direction and the circumferential direction of the turbine ring, with tabs extending from the outside face of the annular base over the circumferential ends of said annular base, circumferential edges of the tabs and the circumferential edges of the circumferential ends of each of the plurality of ring sectors being held respectively facing the circumferential edges of tabs and the circumferential edges of adjacent ring sectors of the plurality of ring sectors in the turbine ring, and wherein the turbine ring assembly includes a plurality of rigid gaskets, each of the plurality of the rigid gaskets extending axially between two adjacent ring sectors of the plurality of ring sectors, together with resilient holder devices exerting force holding the plurality of rigid gaskets in contact with the circumferential ends or the tabs of two adjacent ring sectors of the plurality of ring sectors, wherein the ring support structure has an upstream annular radial flange and a downstream annular radial flange with the plurality of ring sectors being held between them without being attached to said upstream annular radial and downstream annular radial flanges, each of the plurality of rigid gaskets having an upstream end passing through a slot formed in the upstream annular radial flange and a downstream end passing through a slot formed in the downstream annular radial flange.

2. The turbine ring assembly of claim 1, wherein each of the resilient holder devices comprises a spring element present beside the outside face of the ring support structure.

3. The turbine ring assembly of claim 2, wherein the plurality of rigid gaskets are constituted by strips of ceramic matrix composite material.

4. The turbine ring assembly of claim 2, wherein each of the resilient holder devices comprises a bolt and a spring, the bolt having a head present between the outside face of one of the plurality of rigid gaskets and tabs of two adjacent ring sectors of the plurality of ring sectors, the spring being mounted in a prestressed state between a shroud of the ring support structure and a nut fastened to the end of the bolt remote from its end having the head.

5. The turbine ring assembly of claim 2, wherein each resilient holder device comprises a finger having a free end pressing against a ring sector of the plurality of ring sectors, there being a spring element mounted in a prestressed state against each finger.

6. The turbine ring assembly of claim 5, wherein an annular gasket extends over the ring sectors, said annular gasket being interposed between the free ends of the fingers of the resilient holder devices and the ring sectors.

* * * * *